US007446251B2

(12) United States Patent
Lee

(10) Patent No.: US 7,446,251 B2
(45) Date of Patent: Nov. 4, 2008

(54) MUSICAL ACCESSORY HAVING TUNER AND/OR METRONOME AND HAVING POWER GENERATION FUNCTION

(75) Inventor: Hyun Duck Lee, Inchon (KR)

(73) Assignee: Duck Jean Enterprise Co., Ltd., Inchon (KR)

( * ) Notice: Subject to any disclaimer, the term of this patent is extended or adjusted under 35 U.S.C. 154(b) by 142 days.

(21) Appl. No.: 11/533,994

(22) Filed: Sep. 21, 2006

(65) Prior Publication Data

US 2007/0256534 A1 Nov. 8, 2007

(30) Foreign Application Priority Data

Apr. 25, 2006 (KR) ..... 10-2006-0036992

(51) Int. Cl.
*G10G 7/02* (2006.01)

(52) U.S. Cl. ..... 84/454; 84/455; 84/458; 84/477 R; 84/723

(58) Field of Classification Search ..... None
See application file for complete search history.

(56) References Cited

U.S. PATENT DOCUMENTS 5,016,515 A * 5/1991 Scott ..... 84/454
5,850,048 A * 12/1998 Ruf ..... 84/484
6,894,212 B2 * 5/2005 Capano ..... 84/454

* cited by examiner

*Primary Examiner*—Marlon T Fletcher
(74) *Attorney, Agent, or Firm*—Greenblum & Bernstein, P.L.C.

(57) ABSTRACT

Disclosed is a musical accessory, equipped with a tuner for stringed instruments and/or a metronome, capable of generating power by itself, which is convenient to use. In an aspect, the musical accessory comprises a casing housing a sensor, an amplifier, an A/D converter, an indication unit, a microprocessor, and a power supply unit, wherein the power supply unit includes a driver pivotably installed on one side of the casing, a power generation module for generating electromotive force by receiving rotary power from the driver, and a charger connected to the power generation module and storing some amount of the electromotive force, wherein the musical accessory is operated by receiving power from the charger. In another aspect, the musical accessory comprises a casing housing a tempo and beat selection unit, a microprocessor, and a power supply unit which are installed in the casing, wherein the power supply unit includes a driver pivotably installed on one side of the casing, a power generation module for generating electromotive force by receiving rotary power from the driver, and a charger connected to the power generation module and storing some amount of the electromotive force, wherein the musical accessory is operated by receiving power from the charger.

19 Claims, 6 Drawing Sheets

MUSICAL ACCESSORY HAVING TUNER AND/OR METRONOME AND HAVING POWER GENERATION FUNCTION

BACKGROUND OF THE INVENTION

1. Field of the Invention

The present invention relates to a musical accessory having a tuner and/or a metronome having a power generation function, and more particularly, to a musical accessory having a tuner and/or a metronome having a self-power generation function, which is convenient to use because the structure of a musical accessory is modified to serve as a battery for a predetermined time.

2. Description of the Related Art

Conventional tuners tune musical accessories to make precise notes and are generally driven by electric power from batteries.

The conventional tuners driven by batteries have the disadvantage in that batteries need changing while they are being used when they are used up. Accordingly, users should always carry batteries.

The conventional tuners have a further disadvantage in that they incur high maintenance cost since they require batteries to be changed.

SUMMARY OF THE INVENTION

Therefore, the present invention has been made in view of the above problems, and it is an object of the present invention to provide a musical accessory having a tuner for stringed instruments or a metronome having a power generation function, so that a user can conveniently use the musical accessory.

In accordance with one aspect of the present invention, the above and other objects can be accomplished by the provision of a musical accessory comprising a casing housing a sensor, an amplifier, an A/D converter, an indication unit, a microprocessor, and a power supply, wherein the power supply unit includes a driver pivotably installed on one side of the casing, a power generation module for generating electromotive force by receiving rotary power of the driver, and a charger connected to the power generation module and storing some amount of the electromotive force, wherein the musical accessory is operated by receiving power from the charger.

In accordance with a further aspect of the present invention, the above and other objects can be accomplished by the provision of a musical accessory comprising a casing housing a tempo and beat selection unit, a microprocessor, and a power supply unit, wherein the power supply unit includes a driver pivotably installed on one side of the casing, a power generation module for generating electromotive force by receiving rotary power from the driver, and a charger connected to the power generation module and storing some amount of the electromotive force, wherein the musical accessory is operated by receiving power from the charger.

BRIEF DESCRIPTION OF THE DRAWINGS

The above and other objects, features and other advantageous effects of the present invention will be more clearly understood from the following detailed description taken in conjunction with the accompanying drawings, in which.

DESCRIPTION OF THE PREFERRED EMBODIMENTS

Hereinafter, a musical accessory having a tuner for stringed instruments and a metronome having an electric power generation function according to a preferred embodiment of the present invention will be described with reference to accompanying drawings.

Figure 1:
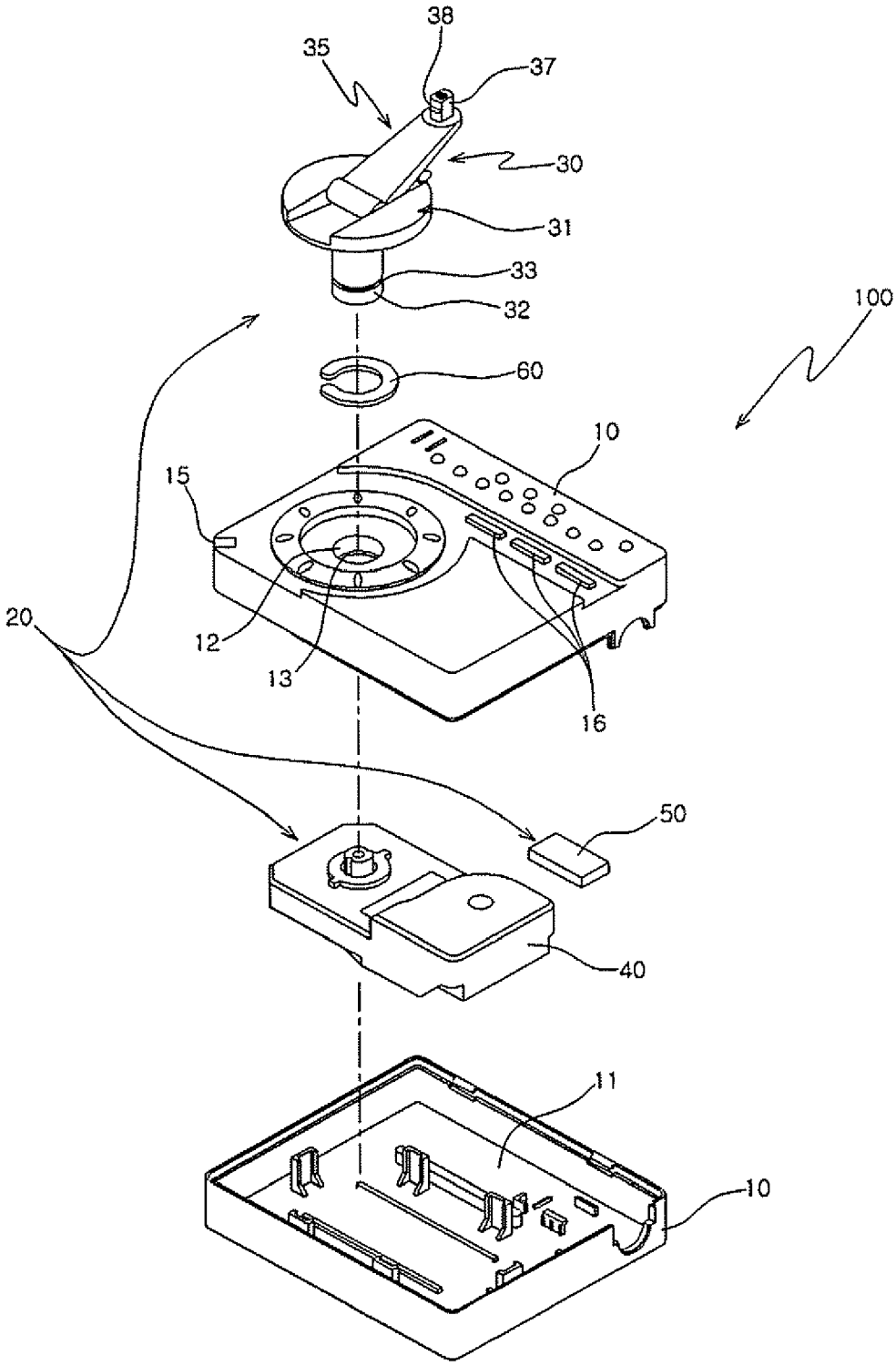
FIG. 1 is an exploded perspective view illustrating a musical accessory according to one embodiment of the present invention.
Figure 2:
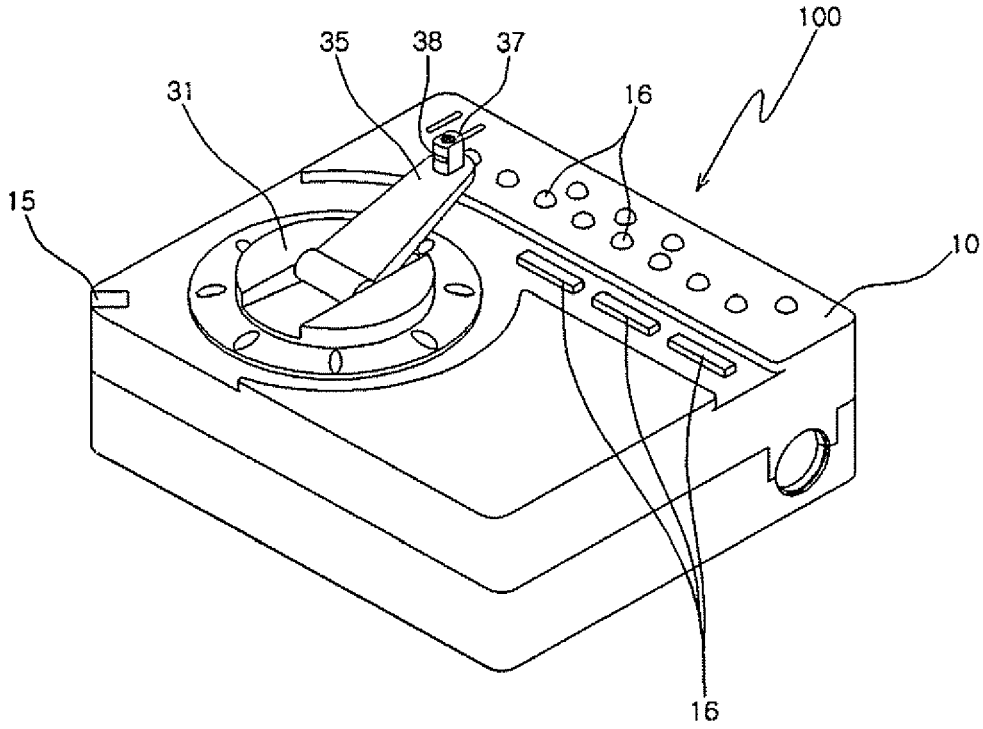
FIG. 2 is a perspective view illustrating the musical accessory according to one embodiment of the present invention.
Figure 3:
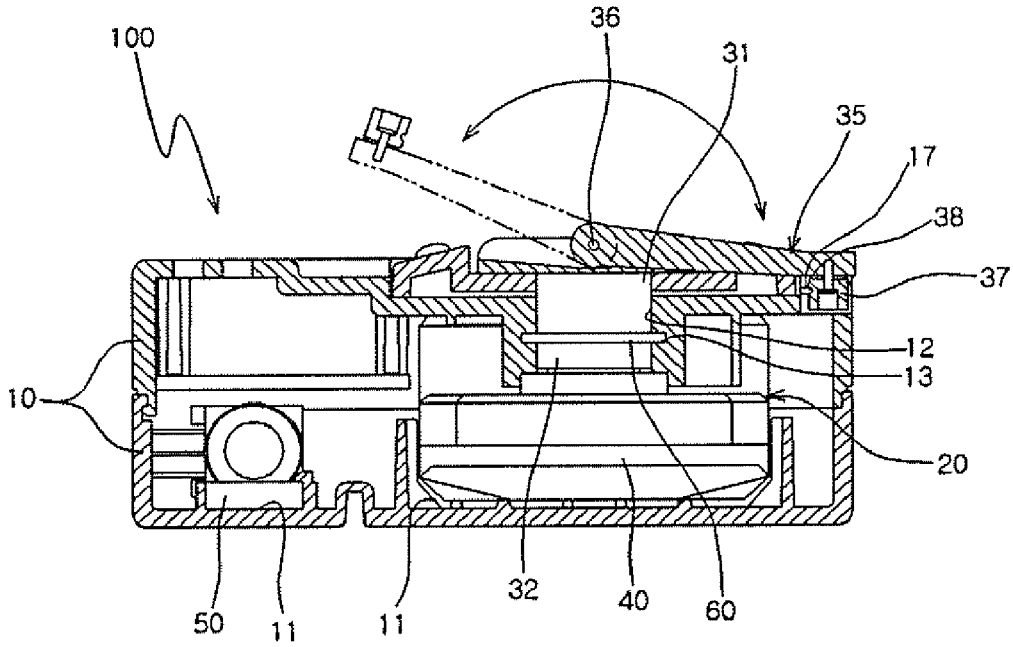
FIG. 3 is a sectional view illustrating the musical accessory according to one embodiment of the present invention.
Figure 4:
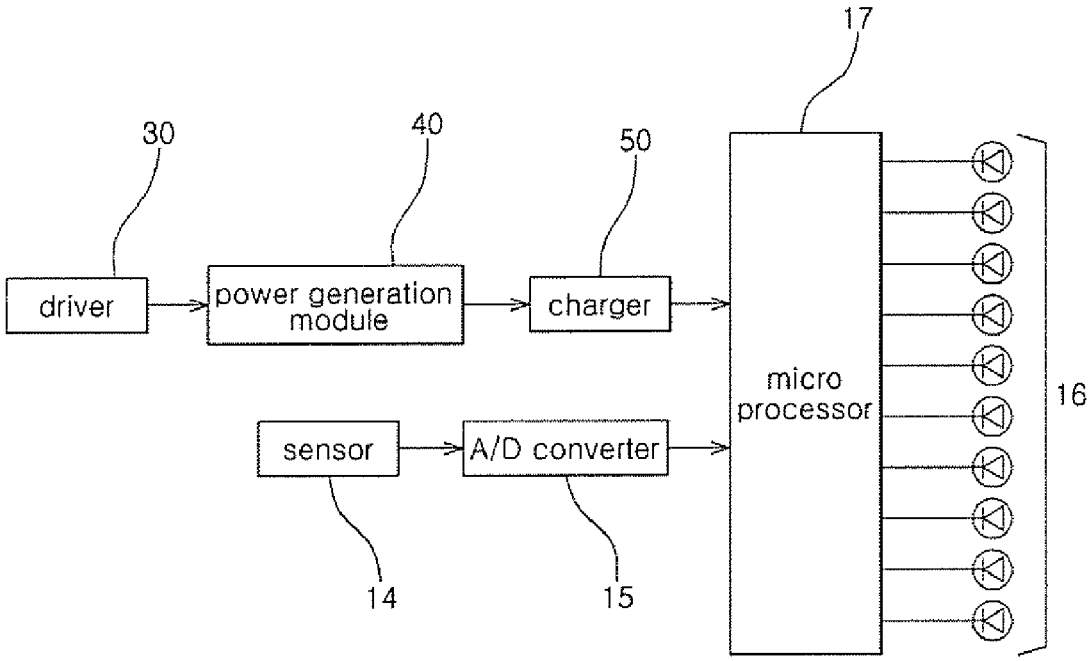
FIG. 4 and FIG. 5 are block diagrams illustrating the musical accessory according to one embodiment of the present invention.
Figure 5:
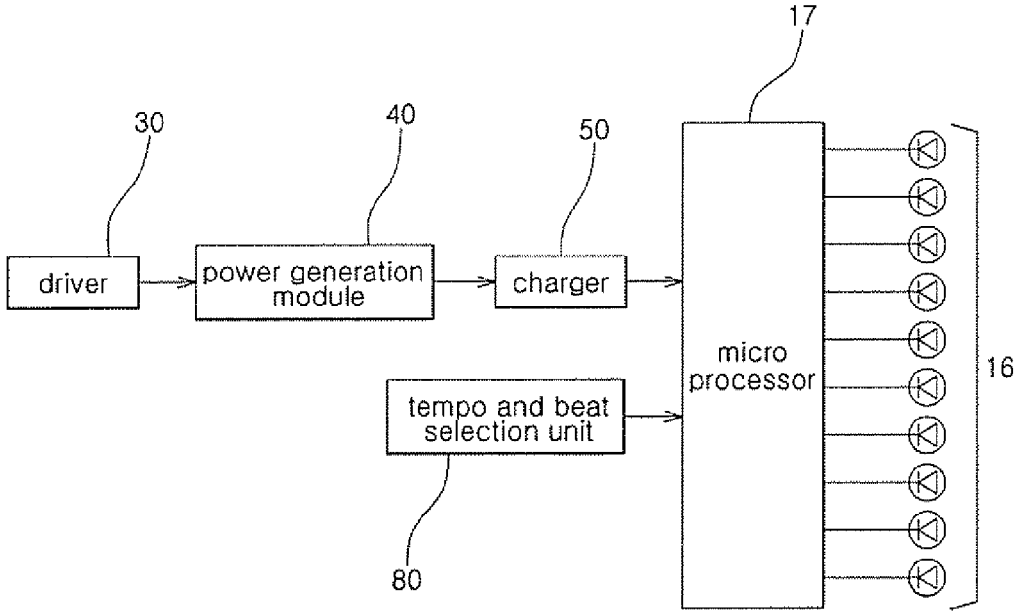
Figure 6:
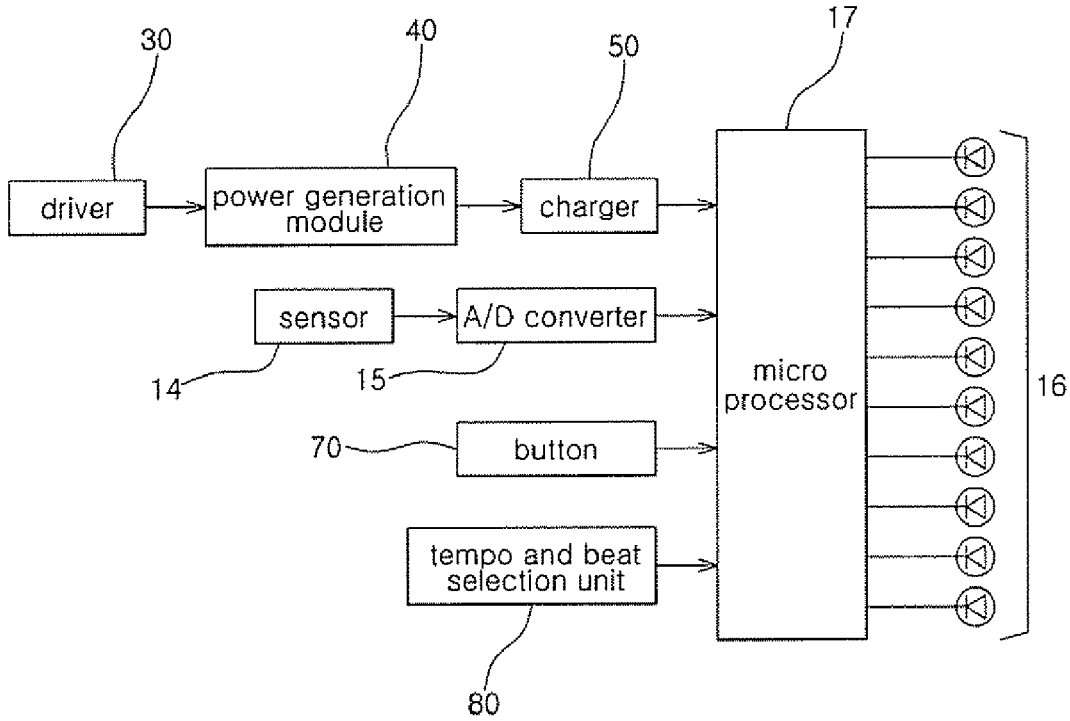
FIG. 6 is a block diagram illustrating a musical accessory according to a further embodiment of the present invention.

FIG. 1 is an exploded perspective view, FIG. 2 is a perspective view, FIG. 3 is a sectional view, and FIG. 4 and FIG. 5 are block diagrams, illustrating a musical accessory according to one embodiment of the present invention, and FIG. 6 is a block diagram of a musical accessory according to a further embodiment of the present invention.

As shown in FIG. 1 through FIG. 4, the musical accessory having a tuner for stringed instruments and a metronome includes a casing 10, a sensor 14 installed in the casing 10, an A/D converter 15, an indication unit 16, a microprocessor 17 and a power supply unit 20 for supplying power. The power supply unit 20 includes a driver 30 pivotably installed on one side of the casing 10, a power generation module 40 for generating electromotive force by receiving rotary power from the driver 30, and a charger 50 connected to the power generation module 40 and storing some amount of the electromotive force.

The casing 10 has a mounting recess 11 so that the power generation module 40 and the charger 50 are adequately arranged in the casing 10. The casing 10 further has a connection part 12 formed through an upper portion thereof, and the connection part 12 has a ring-shaped groove 13 on the inner surface thereof.

The casing 10 still further has a groove 15 on an edge portion thereof for receiving a branched part 37 of a handle therein.

A hooking projection 17 is provided on one side of the groove 15.

A plurality of light emitting diodes (LEDs) of the indication unit 16 is installed at regular intervals along an outer edge portion of the casing 10 in a manner such that they are exposed outside the casing 10, and a plurality of buttons 16 for transmitting signals to the microprocessor 17 is formed.

The driver 30 comprises a body 31 having a rotational shaft 32 to be combined with the casing 10 and the power generation module 40, and a handle 35 coupled to an upper portion of the body 10 in a hinging manner for pivoting the handle 35.

The rotational shaft 32 having a predetermined length extends straight down from a lower end portion of the body 31, and has a fixing groove 33 on the outer surface thereof.

A first end of the handle 35 is pivotably coupled to an upper portion of the body 31 in a hinged manner, and a second end of the handle 35 has the branched part 37 coupled thereto in a rotating manner.

The branched part 37 has a fixing groove 38 on a side thereof.

The fixing groove 38 of the branched part 37 and the hooking projection 17 of the groove 15 are detachably engaged with each other.

The casing 10 and the driver 30 are coupled via a fixing member 60 disposed between the ring-shaped groove 13 of the coupling unit 12 and the fixing groove 33 of the rotational shaft 32. The fixing member 60 enables the driver 30 to rotate and prevents separation of the driver 30.

The rotational shaft 32 of the driver 30 and the power generation module 40 are detachably coupled to each other, and have structures capable of transferring rotary power.

The power generation module 40 receives the rotary power from the driver 30 and then generates electromotive force. The power generation module 40 has a typical structure.

The charger 50 provides electromotive force generated by the power generation module 40, and is configured to provide current of 110V or 220V. The charger is an optional element, and is thus included according to need.

The charger 50 may comprise a storage battery capable of storing current by receiving power from an external power source, or a typical battery. The power supply unit 20 and the charger 50 can be implemented as one element.

The operation of the musical accessory having a tuner for stringed instruments or a metronome having a power production function will be described with reference to FIG. 3. First, if a user holds the branched part 37 and pivots the handle 35 in one direction, the driver 30 coupled to the casing 10 pivots stably thanks to the fixing member 60, so that rotary power is transferred to the power generation module 40. At this time, the power generation module 40 generates electromotive force, and the electromotive force is transferred to the charger 50, so that charging is performed when charging is completed, the microprocessor 17 detects completion of the charging, and the LEDs on the casing 10 emit green light.

That is, the musical accessory is operated in a manner such that when rotary power is transferred to the power generation module 40 from the driver 30, electromotive force generated in the power generation module 40 is stored into the charger 50, and a tuner for stringed instruments or a metronome 100 starts to work. At this time, the sensor 14 detects the frequency of sound of an instrument. The detected frequency of a square wave is converted into a sine wave by an amplifier (not shown), the sine wave is then converted into an electrical signal by the A/D converter 15, and the electrical signal is finally transferred to the microprocessor 17.

In the case that the musical accessory includes a tuner 100 for stringed instruments, the tuner 100 compares the musical scale of vibrating sound input to the microprocessor 17 with frequencies of predetermined standard pitches, sends a flickering signal to the indication unit 16 so as to indicate the difference between the closest standard pitch and the pitch of the input vibrating sound, and enables the LED to flicker with green light when the pitch of the input frequency is the same as any one of the predetermined reference pitches.

FIG. 5 illustrates a block diagram of the musical accessory having a metronome. When explaining the operation of the musical accessory shown in FIG. 6, descriptions that repeat those implemented in the musical accessory shown in FIG. 4 will be omitted. When the metronome 100 detects the tempo of sound played by the musical accessory, the microprocessor 17 transfers a signal having a predetermined pulse. As a result, the LEDs of the indication unit 16 turn on and off in left and right directions, so as to indicate tempo and beat of the musical accessory.

As described above, the microprocessor 17 of the metronome 100 has a tempo and beat selection unit 80 for selecting a tempo or a beat, so that the metronome can selectively detect tempo or beat when a user pushes a button for operating the tempo and beat selection unit 80.

Alternatively, the selection unit 80 can select a tempo or beat when a user rotates the button for operating the tempo and beat selection unit 80.

FIG. 6 illustrates the musical accessory having an element selectively serving as a tuner and/or a metronome according to a further embodiment of the present invention. A button 16 is provided to a casing 10 in a manner such that it is exposed outside a casing 10. A microprocessor 17 detects an operation of pushing the button 16, and switches its mode so as to serve as a tuner for stringed instruments or a metronome.

The musical accessory described above has an advantageous effect in that it can solve problems encountered in conventional musical accessories by modifying a tuner for stringed instruments or a metronome so as to have self-power function, thereby enabling a user to conveniently use the musical accessory.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A musical accessory, equipped with a tuner for stringed instruments, capable of generating electric power by itself, comprising a casing housing a sensor, an A/D converter, an indication unit, a microprocessor, and a power supply unit for supplying power, wherein the power supply unit includes:

a driver pivotably installed on one side of the casing;

a power generation module for generating electromotive force by receiving rotary power from the driver; and a charger connected to the power generation module for storing electromotive force, whereby the tuner is operated when power is delivered from the charger.

2. The musical accessory according to claim 1, wherein the driver comprises a body having a rotational shaft to be coupled to the casing and the power generation module, and a handle installed on an upper end portion of the body to rotate the body.

3. The musical accessory according to claim 2, wherein a first end of the handle is coupled to an upper end portion of the body in a hinged manner, and a second end of the handle has a branched part rotatably coupled thereto.

4. The musical accessory according to claim 1, wherein the casing has a groove into and from which the branched part of the handle can be received and separated.

5. The musical accessory according to claim 4, wherein a groove of the branched part and a hooking projection of the groove are detachably coupled to each other.

6. The musical accessory according to claim 1, wherein the charger comprises a storage battery that is either capable or not capable of storing current by receiving power from an external power source.

7. A musical accessory, equipped with a metronome, capable of generating electric power by itself, comprising a casing housing a tempo and beat selection unit, an indication unit, a microprocessor, and a power supply unit for supplying power, wherein the power supply unit includes:

a driver rotatably installed on one side of the casing;

a power generation module for generating electromotive force by receiving rotary power from the driver; and a charger connected to the power generation module for charging electromotive force, whereby the metronome is operated when electric power is delivered from the charger.

8. The musical accessory according to claim 7, wherein the driver comprises a body having a rotational shaft to be coupled to the casing and the power generation module, and a handle installed on an upper end portion of the body to rotate the body.

9. The musical accessory according to claim 8, wherein a first end of the handle is coupled to an upper end portion of the body in a hinged manner, and a second end of the handle has a branched part rotatably coupled thereto.

10. The musical accessory according to claim 7, wherein the casing has a groove into and from which the branched part of the handle can be received and separated.

11. The musical accessory according to claim 10, wherein a groove of the branched part and a hooking projection of the groove are detachably coupled to each other.

12. The musical accessory according to claim 7, wherein the charger comprises a storage battery that is either capable or not capable of storing current by receiving power from an external power source.

13. The musical accessory according to claim 7, wherein the metronome operates in a manner such that light of LEDs of the indication unit moves left and right for adjustment of a tempo of the musical accessory when the sensor detects the tempo of the musical accessory and the microprocessor sends a signal having predetermined pulses.

14. A musical accessory, equipped with a tuner for stringed instruments or a metronome, capable of generating electric power by itself, comprising a casing housing a sensor, an A/D converter, a tempo and beat selection unit, an indication unit, a microprocessor, and a power supply unit for supplying power, wherein the accessory includes a button installed to be exposed outside the casing for sending a signal to the microprocessor which selectively serves as the tuner or the metronome in response to operation of the button, and wherein the power supply unit includes:

a driver rotatably installed on one side of the casing;

a power generation module for generating electromotive force by receiving rotary power from the driver; and a charger connected to the power generation module for charging electromotive force, whereby the tuner and the metronome are operated when electric power is delivered form the charger.

15. The musical accessory according to claim 14, wherein the driver comprises a body having a rotational shaft to be coupled to the casing and the power generation module, and a handle installed on an upper end portion of the body to rotate the body.

16. The musical accessory according to claim 15, wherein a first end of the handle is coupled to an upper end portion of the body in a hinged manner, and a second end of the handle has a branched part rotatably coupled thereto.

17. The musical accessory according to claim 14, wherein the casing has a groove into and from which the branched part of the handle can be received and separated.

18. The musical accessory according to claim 17, wherein a groove of the branched part and a hooking projection of the groove are detachably coupled to each other.

19. The musical accessory according to claim 14, wherein the charger comprises a storage battery that is either capable or not capable of storing current by receiving power from an external power source.

* * * * *